US010704859B2

(12) United States Patent
Pearce

(10) Patent No.: US 10,704,859 B2
(45) Date of Patent: Jul. 7, 2020

(54) COMPRESSED GAS GUN FRONT GRIP HAVING BATTERY ACCESS PANEL

(71) Applicant: GI SPORTZ DIRECT LLC, Sewell, NJ (US)

(72) Inventor: Mark Roland Pearce, Lindenwold, NJ (US)

(73) Assignee: GI SPORTZ DIRECT LLC, Sewell, NJ (US)

( * ) Notice: Subject to any disclaimer, the term of this patent is extended or adjusted under 35 U.S.C. 154(b) by 0 days.

(21) Appl. No.: 16/182,270

(22) Filed: Nov. 6, 2018

(65) Prior Publication Data

US 2020/0141688 A1 May 7, 2020

(51) Int. Cl.

| | |
|---|---|
| ***F41C 23/16*** | (2006.01) |
| ***F41B 11/70*** | (2013.01) |
| ***F41G 1/34*** | (2006.01) |
| ***F41B 11/62*** | (2013.01) |

(52) U.S. Cl.
CPC ..... *F41B 11/70* (2013.01); *F41B 11/62* (2013.01); *F41C 23/16* (2013.01)

(58) Field of Classification Search
CPC ..... F41C 23/16; F41B 11/70; F41B 11/62; F41G 1/34; F41G 1/35
USPC ..... 362/110; 42/146; 124/80
See application file for complete search history.

(56) References Cited

U.S. PATENT DOCUMENTS

| | | | |
|---|---|---|---|
| 36,571 | A | 9/1862 | Moses |
| 572,290 | A | 12/1896 | Clement |
| 1,183,644 | A | 5/1916 | Hill |
| 1,545,465 | A | 7/1925 | Johnstone et al. |
| 2,150,288 | A | 2/1937 | Moller |
| 3,153,874 | A | 10/1964 | Merrill |
| 3,229,400 | A | 1/1966 | Del Pozo, Jr. |
| 3,233,601 | A | 2/1966 | Walther |
| 3,318,192 | A | 5/1967 | Miller et al. |
| 3,379,188 | A | 4/1968 | Walther |
| 3,561,149 | A | 2/1971 | Center |
| 3,791,256 | A | 2/1974 | Curtis et al. |
| 3,913,553 | A | 10/1975 | Braughler et al. |
| 3,996,684 | A | 12/1976 | Bauman et al. |
| 3,996,685 | A | 12/1976 | Bauman et al. |
| 4,044,487 | A | 8/1977 | Hutton et al. |
| 4,299,046 | A | 11/1981 | Atchisson |

(Continued)

FOREIGN PATENT DOCUMENTS

| | | | |
|---|---|---|---|
| GB | 2 056 635 | A | 3/1981 |
| WO | 02 42708 | A1 | 5/2002 |

OTHER PUBLICATIONS

FT-12 Owner's Manual, Ver. 05/12, Manufactured by Tippman (24 pages).

(Continued)

*Primary Examiner* — Alexander R Niconovich
(74) *Attorney, Agent, or Firm* — Volpe and Koenig, P.C.

(57) ABSTRACT

A foregrip for a projectile launcher is disclosed. The foregrip includes a proximal longitudinal end mounted to a projectile launcher and a distal longitudinal end positioned away from a projectile launcher. An access panel is hinged to a battery compartment at the distal longitudinal end of the foregrip. A release button separates the access panel from the foregrip. The release button is located on the proximal longitudinal end of the foregrip.

7 Claims, 5 Drawing Sheets

(56) References Cited

U.S. PATENT DOCUMENTS 4,344,410 A * 8/1982 Curran ..... F41B 11/62 124/74
4,541,192 A 9/1985 Flodman et al.
4,660,311 A 4/1987 Breiffeld et al.
4,757,627 A 7/1988 Saligari
4,774,929 A 10/1988 Milliman
4,999,939 A 3/1991 Reese et al.
5,062,231 A 11/1991 Braverman et al.
5,160,795 A 11/1992 Milliman
5,165,383 A 11/1992 Ebert et al.
5,225,610 A 7/1993 Uria
5,335,581 A 8/1994 Simon et al.
5,375,362 A * 12/1994 McGarry ..... F41A 35/06 42/117
5,404,863 A 4/1995 Poor
5,529,050 A 6/1996 D'Andrade
5,610,362 A 3/1997 Bouvard
5,622,160 A 4/1997 Casas Salva
5,711,286 A 1/1998 Petrosyan et al.
5,878,736 A * 3/1999 Lotuaco, III ..... F41B 11/52 124/71
5,884,615 A 3/1999 Casa Salva
6,119,671 A 9/2000 Smith et al.
6,152,333 A * 11/2000 Binder ..... B05C 17/015 222/333
6,539,659 B2 4/2003 Casa Salva
6,578,565 B2 6/2003 Casas Salva
6,622,416 B2 * 9/2003 Kim ..... F41G 1/35 362/110
6,637,310 B2 10/2003 Borgwarth
6,705,035 B2 3/2004 Gussalli Beretta
6,766,795 B1 7/2004 Sullivan
6,811,099 B2 * 11/2004 Krestine ..... B05B 9/0861 222/333
6,907,687 B2 6/2005 Rousseau et al.
7,207,130 B2 4/2007 Rousseau et al.
7,290,539 B2 * 11/2007 Maeda ..... F41B 11/62 124/63
7,591,098 B2 * 9/2009 Matthews ..... F41G 11/003 362/110
7,624,723 B2 * 12/2009 Gardner, Jr. ..... F41A 9/53 124/1
7,690,373 B2 4/2010 Telford et al.
7,726,061 B1 * 6/2010 Thummel ..... F41G 11/001 42/115
7,730,882 B2 * 6/2010 Liu ..... F41B 11/62 124/74
7,814,695 B1 10/2010 Keeney et al.
7,861,451 B1 * 1/2011 Moody ..... F41A 23/08 42/71.01
7,900,622 B2 3/2011 Douglas et al.
7,941,954 B2 5/2011 Carr et al.
8,056,277 B2 * 11/2011 Griffin ..... F41C 23/16 42/71.01
8,117,782 B2 * 2/2012 Gross ..... F41C 23/16 362/110
8,118,017 B2 2/2012 Lammonds
8,146,580 B2 * 4/2012 Wei ..... B25C 1/08 124/74
8,225,542 B2 * 7/2012 Houde-Walter ..... F41A 35/00 42/72
8,333,181 B1 12/2012 Rice
8,341,866 B1 * 1/2013 Gaddini ..... F41G 11/003 42/71.01
8,393,104 B1 * 3/2013 Moody ..... F41C 23/14 42/71.01
8,402,683 B2 * 3/2013 Cabahug ..... F41C 23/22 42/85
8,550,061 B2 * 10/2013 Maeda ..... F41B 11/62 124/56
8,550,062 B2 * 10/2013 Maeda ..... F41B 11/62 124/56
8,683,731 B2 * 4/2014 Kowalczyk ..... F41G 1/35 42/111
8,683,990 B2 4/2014 Macy
8,707,604 B2 * 4/2014 Troy ..... F41C 23/16 248/169
8,839,542 B2 9/2014 Dubois et al.
8,899,219 B2 12/2014 Macy
8,950,387 B2 2/2015 Stevens
9,062,933 B1 * 6/2015 Allen ..... F41G 1/35
9,182,194 B2 * 11/2015 Moore ..... F41C 23/16
9,228,804 B2 * 1/2016 Syrengelas ..... F41C 7/02
9,488,445 B2 * 11/2016 Houde-Walter ..... F41G 1/35
9,879,945 B2 * 1/2018 Tuller, Jr. ..... F41G 1/00
9,891,023 B2 * 2/2018 Compton ..... F41G 11/003
9,921,027 B2 * 3/2018 Bruhns ..... F41C 23/10
10,295,303 B2 * 5/2019 Buys ..... F41B 11/55
10,323,901 B2 6/2019 Masse
2008/0295818 A1 12/2008 Styles et al.
2009/0025701 A1 1/2009 Douglas
2009/0120420 A1 5/2009 Tippmann, Jr. et al.
2009/0194088 A1 8/2009 Tippman, Jr. et al.
2009/0277066 A1 11/2009 Burt et al.
2011/0047850 A1 * 3/2011 Rievley ..... F41C 23/16 42/72
2012/0055061 A1 * 3/2012 Hartley ..... F41C 23/16 42/84
2014/0060510 A1 4/2014 Macy
2014/0144418 A1 5/2014 Macy
2014/0209082 A1 7/2014 Stevens
2015/0285577 A1 * 10/2015 Faifer ..... F41A 23/10 42/94
2016/0305736 A1 * 10/2016 Maeda ..... F41B 11/89
2017/0082399 A1 * 3/2017 Moore ..... F41G 1/36
2018/0156569 A1 * 6/2018 Chavez ..... F41C 23/16

OTHER PUBLICATIONS

BT-4 Upgrade Kit Installation (Jan. 4, 2011).
BT Delta Elite Operator Manual; BT Paintball Designs, Inc. 3217 East Washington Blvd. Fort Wayne, Indiana 46803 (undated, admitted prior art).
BT Delta Operator Manual; BT Paintball Designs, Inc. 3217 East Washington Blvd. Fort Wayne, Indiana 46803 (Sep. 7, 2007).
BT Omega Owner's Manual (Oct. 2009).
BT-4 Marker Series Operator Manual; BT Paintball Designs, Inc. 3217 East Washington Blvd. Fort Wayne, Indiana 46803 (undated, admitted prior art).
BT-4 Series Markers Owner's Manual; Empire Battle Tested Paintball 11723 Lime Kiln Rd., Neosho, MO 64850 (2010).
TM7 Owner's Manual; Empire Battle Tested Paintball 11723 Lime Kiln Rd., Neosho, MO 64850 (2010).
Invert Mini Manual; Kee Action Sports, 570 Mantua, NJ 08080 (Sep. 8, 2008).
Invert Mini Manual; Kee Action Sports, 570 Mantua, NJ 08080 (2006).
Owner's Manual Tactical Folding Foregrip; JT USA LLC; 252 Granite Street, Corona, CA 92879 U.S.A. (Dec. 2005).
Viewloader .68 Caliber Semi-Automatic Paintball Markerowner's Manual and Do's and Don'ts of Marker Care; View Loader® Inc. P.O. Box 1956, Rogers, AR 72757 (Apr. 2003).

* cited by examiner

COMPRESSED GAS GUN FRONT GRIP HAVING BATTERY ACCESS PANEL

FIELD OF THE INVENTION

This invention relates to the field of compressed gas guns, and more particularly, to a compressed gas gun having a foregrip or front grip with a releasable door panel for ease of access to a battery compartment and other internal components of the foregrip.

BACKGROUND

Batteries, such as a standard 9V battery, power various electronic and electromechanical components of a compressed gpas gun and require occasional replacement. The battery may be mounted and housed in a compartment of the foregrip, or in a cartridge-like holder that is removable from a compartment of the foregrip. In or near the battery compartment may be a circuit board and controls (such as a "tournament mode" switch, power on/off switch, etc.). The on/off switch and status indicator(s) (such as a battery power indicator) may be mounted externally proximate the battery and circuit board. Thus, a user (such as a paintball sport player) may have different reasons for accessing a battery compartment.

However, typical compressed gas gun battery compartments may be difficult to access. The compartment may have an access panel that is affixed by several small screws. Therefore, in a sport where compressed gas guns are used, such as paintball, a paintball sport player must stop and slowly proceed to remove the access panel. When in the field of play, this procedure is particularly difficult and problematic.

Thus, there is the need for a compressed gas gun battery access mechanism that provides quick access to the battery and related internal electronics in order to facilitate quick battery replacement along with easy maintenance, cleaning, and upgrading of the internal components.

SUMMARY

The present invention provides for a foregrip for a projectile launcher (compressed gas gun) having a proximal end, a distal end, a battery compartment, an access panel, and a release button. The proximal end is mounted to a projectile launcher and the distal end is positioned away from the projectile launcher. The release button is configured to separate the access panel from the foregrip. The release button is located on the proximal end of the foregrip.

In another embodiment, the present invention is directed to a projectile launcher having a main body, a barrel removably mounted to the main body, and a foregrip mounted to the main body. The foregrip includes an internal battery compartment, an access panel, and a release button. The release button is configured to separate the access panel from the foregrip. The barrel in the mounted position on the main body prevents actuation of the release button, requiring the barrel to be removed prior to actuation.

DETAILED DESCRIPTION

Figure 1:
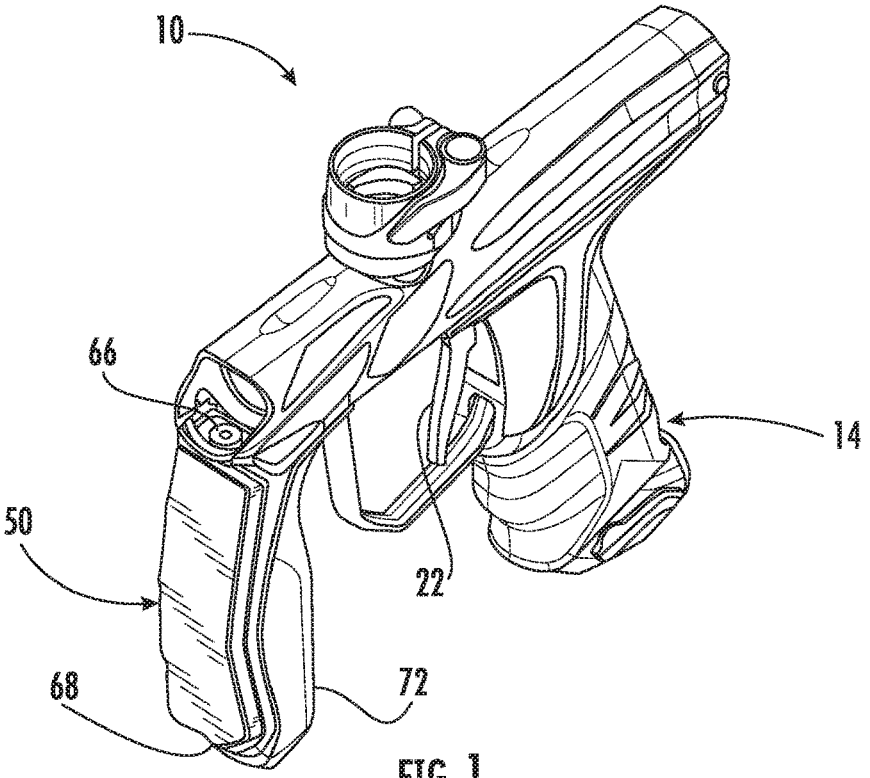
FIG. 1 is a front perspective view of an exemplary compressed gas gun (gun) according to an embodiment of the present application, with a barrel removed.

Certain terminology is used in the following description for convenience only and is not considered limiting. Words such as "front", "back", "top" and "bottom" designate directions in the drawings to which reference is made. This terminology includes the words specifically noted above, derivatives thereof and similar words. Additionally, the terms "a" and "one" are defined as including one or more of the referenced item unless specifically noted. The phrase "at least one" followed by a list of two or more items (such as A, B, or C) means any individual one of A, B or C as well as any combination thereof. The term "substantially" means within ±5% of a given value or ±5 degrees from a given angle, as appropriate. The terms "about" and "generally" mean within ±10% of a given value, as appropriate.

At the outset, it is understood that this invention is not limited only to the particular embodiments, methodology, materials, and modifications described herein, and as such may vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the following example methods, devices, and materials are now described.

Figure 2A:
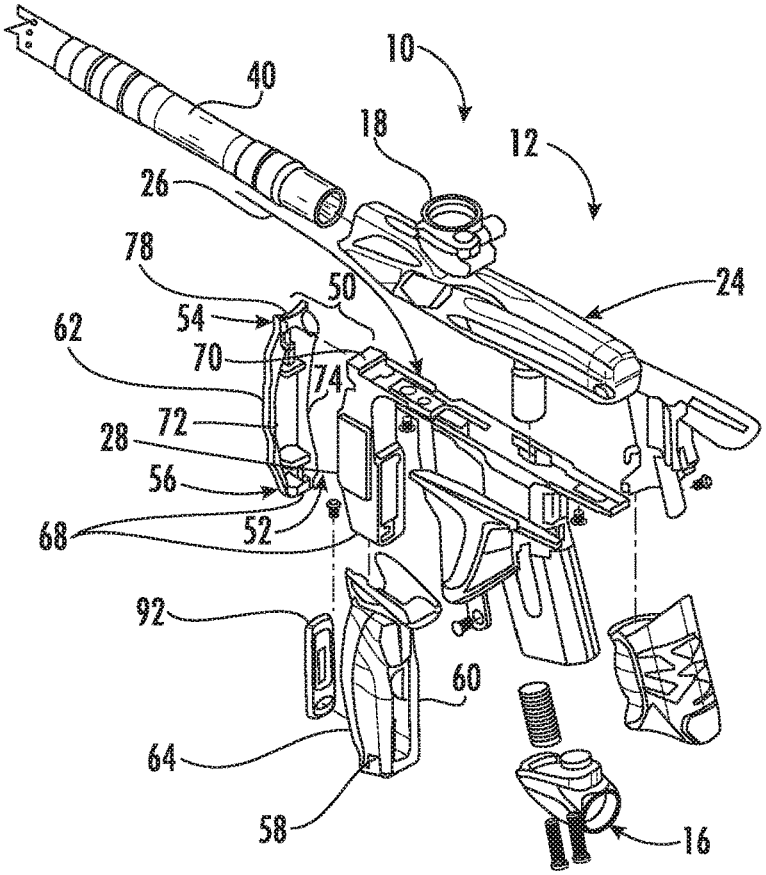
FIG. 2A is an exploded rear perspective view of the compressed gas gun of FIG. 1.
Figure 2B:
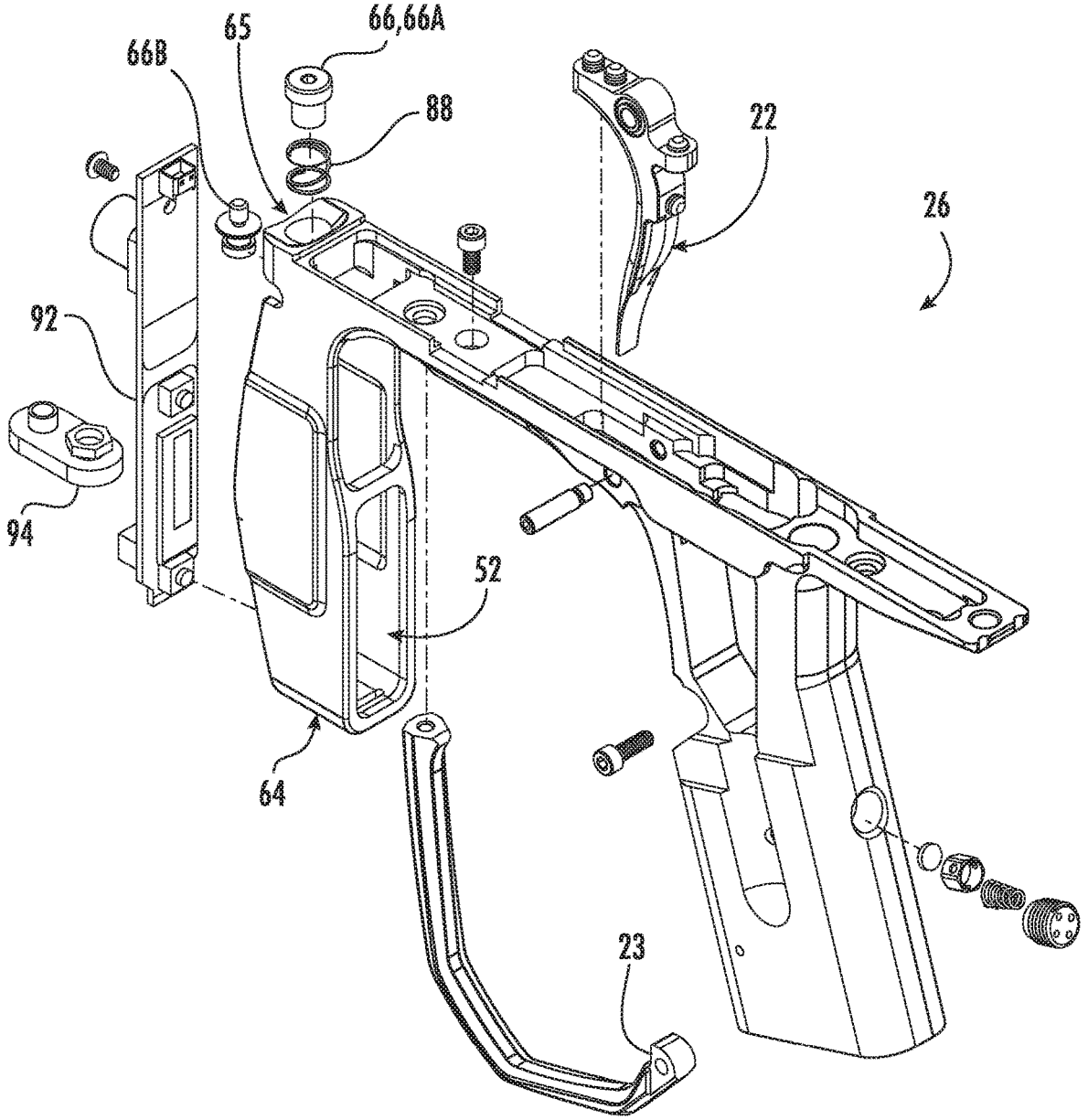
FIG. 2B is a zoomed-in partial view of FIG. 2A with additional details of a lower assembly of the exemplary compressed gas gun.

FIGS. 1-2B show an exemplary embodiment of a compressed gas gun (gun) 10, including a main body 12 with a rear handgrip 14, a removable barrel 40, and a foregrip 50.

Figure 3:
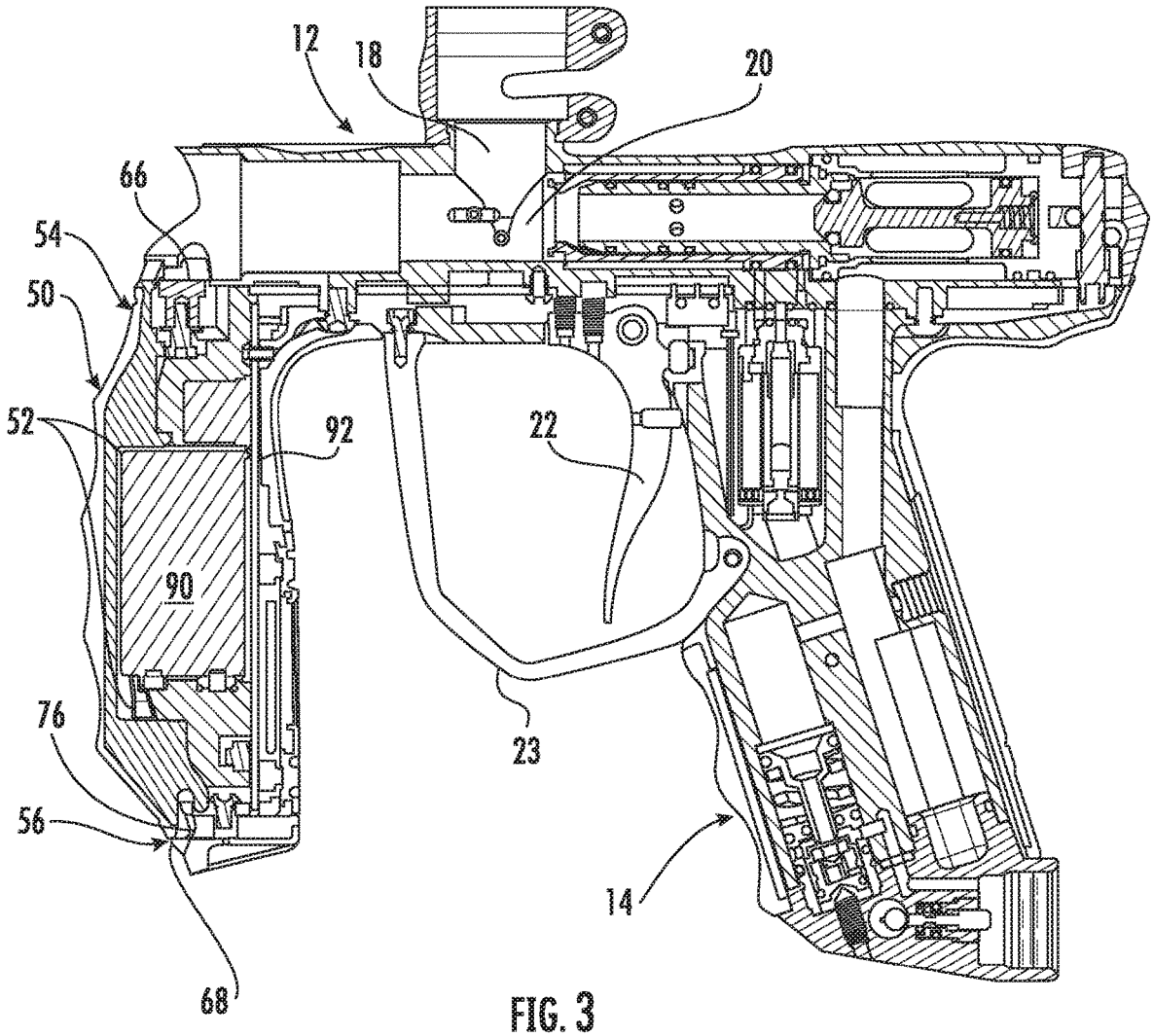
FIG. 3 is a side cross-sectional view of the compressed gas gun of FIG. 1 with the barrel removed.

As shown in FIGS. 2A-3, the main body 12 of the compressed gas gun 10 further includes a connection 16 for a compressed gas cylinder, an inlet tube 18 leading to a firing chamber 20 in the interior of the main body 12, a trigger 22, and a trigger guard 23. The foregrip 50 projects downwardly from the barrel 40 and provides an area for gripping by an operator of the compressed gas gun 10. A compressed gas cylinder is typically secured to the connection 16 at the rear portion of the compressed gas gun 10. The compressed gas cylinder normally contains CO2, although any compressible gas may be used. In the illustrated embodiment, the main body 12 includes an upper body 24 and a lower body 26, the lower body 26 including a frame 28 that extends into the foregrip 50.

A foregrip 50, such as one which may be used for the present invention, is shown in FIGS. 1-6 and includes a body which houses a battery compartment 52, a proximal end 54, a distal end 56, and two sides 58, 60. The foregrip 50 may be in two parts, a front 62 and a rear 64 that are removably attached as further discussed below.

Figure 4:
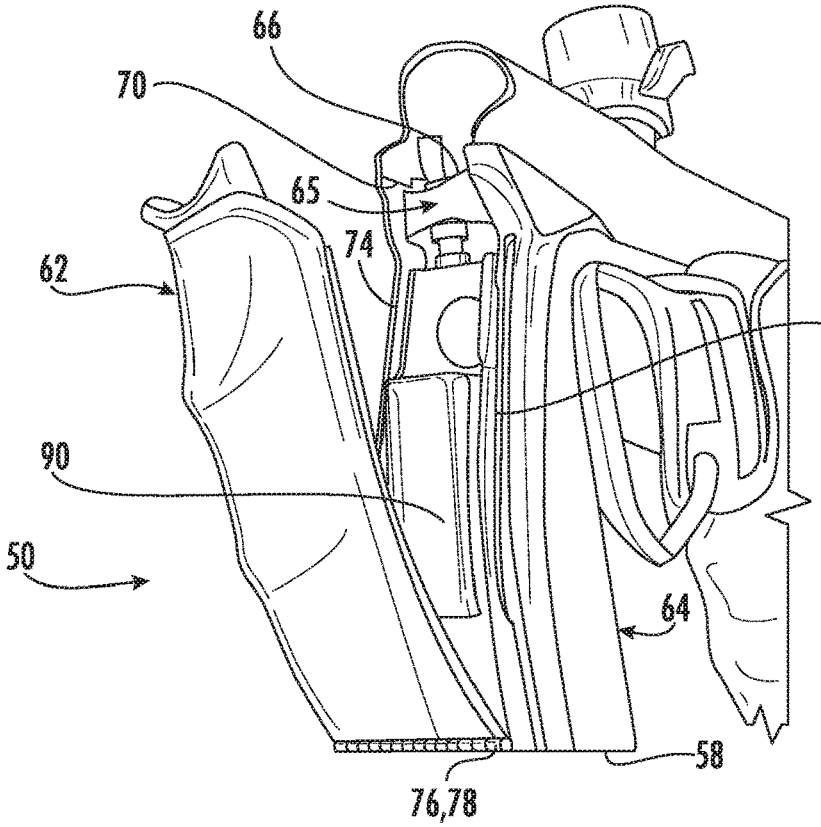
FIG. 4 is a partial front perspective view of a foregrip of the compressed gas gun of FIG. 1 in an open position.

As best shown in FIGS. 2B-6, the foregrip 50 includes a button housing 65 that receives a button 66, also referred to as a release mechanism, for opening the foregrip. The button 66 allows the front 62 and the rear 64 to separate (fully or partially), allowing access to the battery compartment 52. In a preferred embodiment, when the compressed gas gun 10 is assembled with the barrel 40 above the foregrip 50, the button 66 is inaccessible to the user and cannot be accidentally pressed. The button 66 may be mounted to either the front 62 (as shown in FIGS. 3 and 6) or rear 64 (as shown in FIG. 4) of the handgrip 50.

Figure 6A:
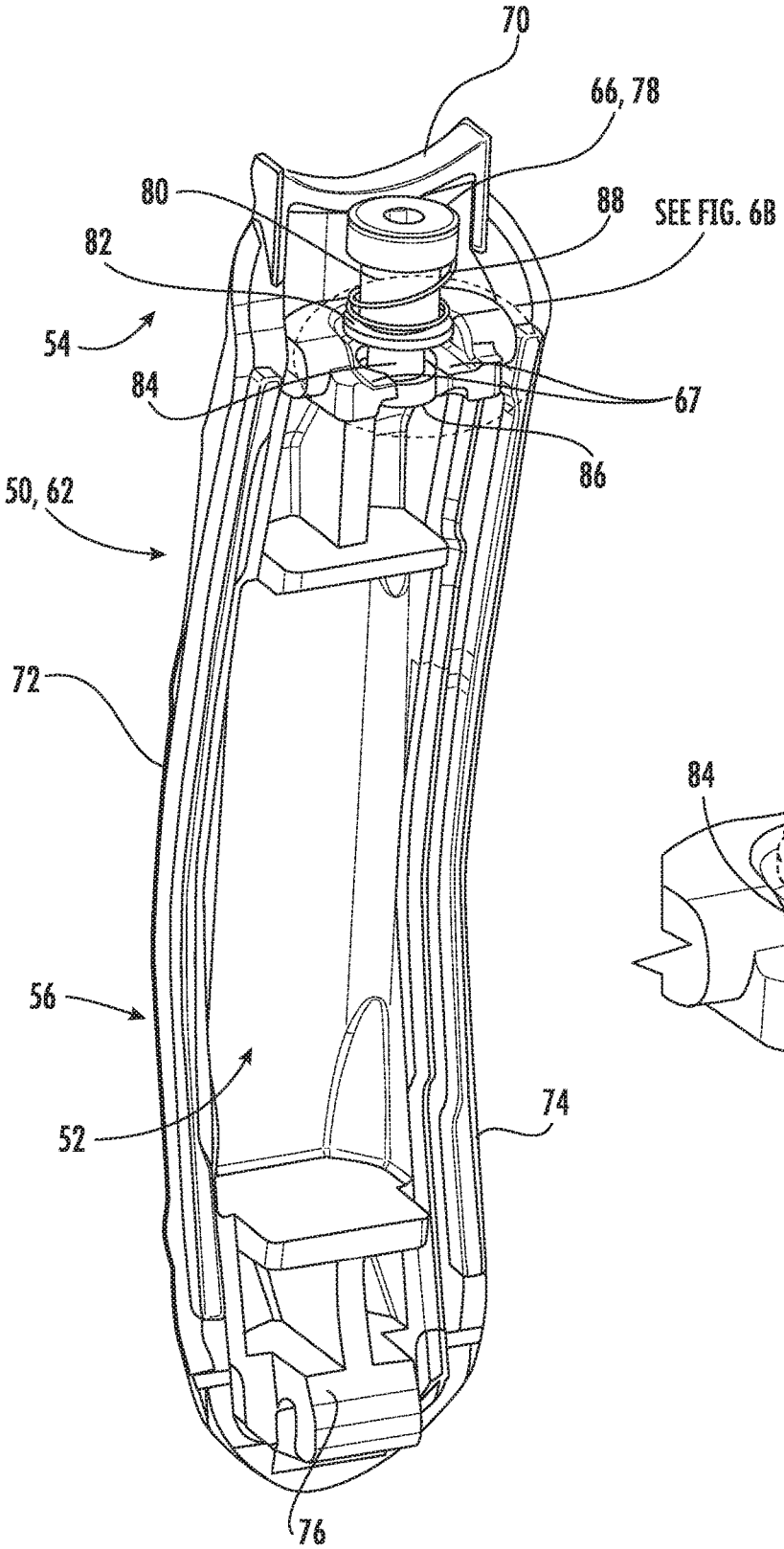
FIG. 6A is a perspective view of a front of the foregrip of the compressed gas gun.
Figure 6B:
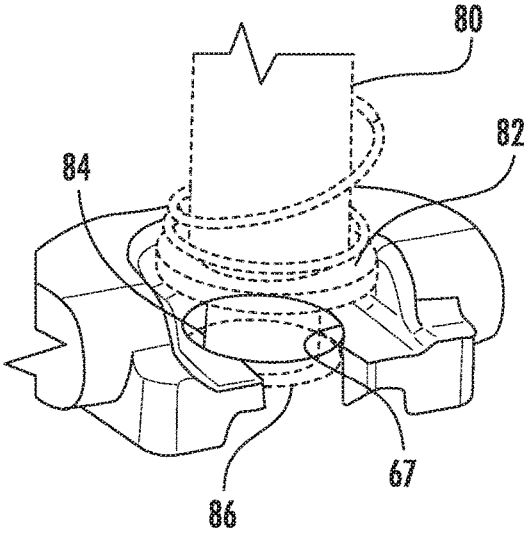
FIG. 6B is a zoomed-in partial view of FIG. 6A with a button shown in relief.

Generally, the front 62 may be considered a door or access panel of the foregrip 50 for accessing the battery compartment 52. One skilled in the art would recognize that various structures may be utilized to attach the front 62 and rear 64 of the foregrip 50. The front 62 may be hinged along a bottom edge 68, a top edge 70, or longitudinally along either side edge 72, 74. The hinge 76 may be a piano hinge, a living hinge, a pivot mechanism, a door/gate hinge, or the like. The hinge 76 may be spring-biased toward an open position or a closed position. As an alternative to a hinge, the front 62 may be completely removable from the rear 64. In any such embodiment, it is preferable to provide a seal or gasket (not illustrated; e.g., rubber) along one or more of the edges 68, 70, 72, and 74 to protect internal components from debris and moisture. As shown in FIGS. 3 and 6A, for the completely removable front 62, a catch 76 holds the front 62 and rear 64 together at the distal end 56, although various other clips and latches are contemplated.

As best shown in FIGS. 2B, 3, 5, 6A, and 6B, the button 66 is generally cylindrical and includes a head 78, a body 80, a waist 82 having a larger width/diameter than the body, a reduced waist portion 84, and a foot 86. The button may be formed from an upper portion 66A and a lower portion 66B that are interfitted. A spring 88, such as a coil spring, biases the button 66 upward and opposite the direction of actuation. The button housing 65 retains the button 66 within the foregrip 50 and guides the button when depressed/actuated downward and when returned upward under bias of the spring 88.

Figure 5:
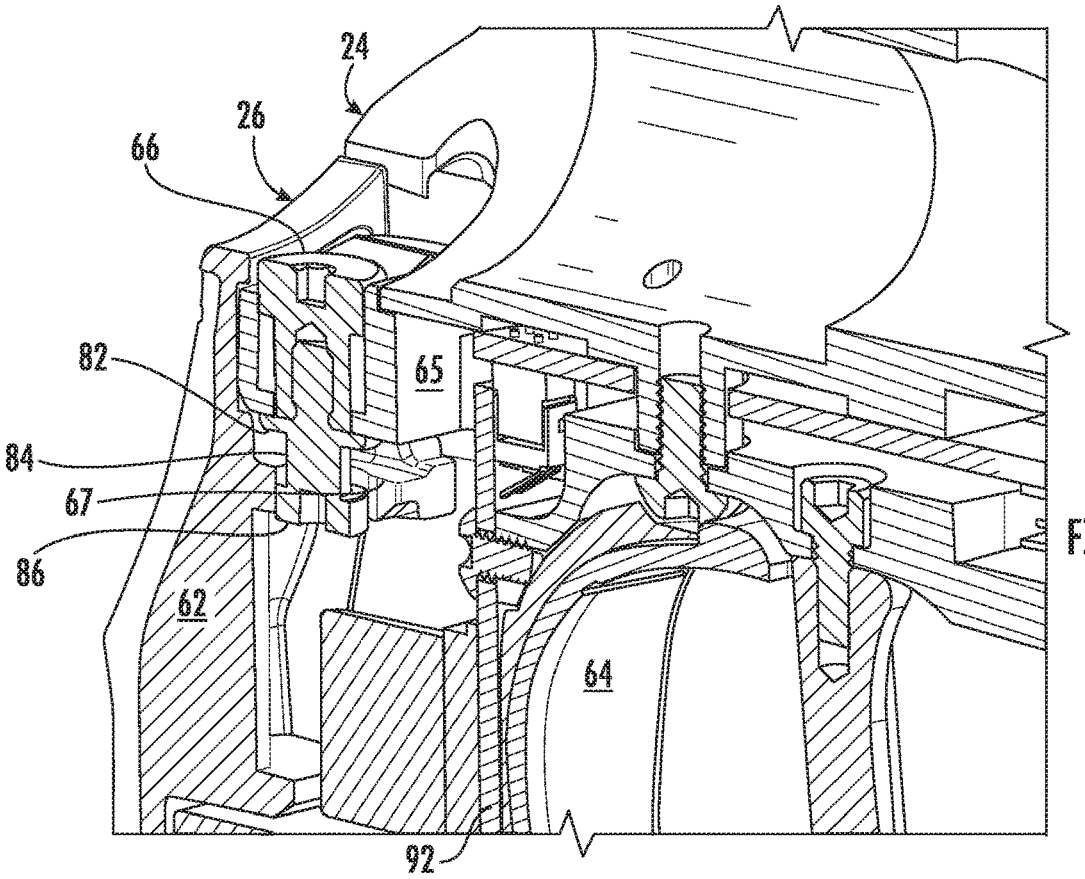
FIG. 5 is a partial side cross-sectional view of the foregrip of the compressed gas gun of FIG. 1.

One skilled in the art would appreciate that depressing the button 66 moves the head 80, waist 82, and/or foot 86 out of engagement with one of the front 62 or rear 64 of the handgrip 50 such that it can be released from the other of the front 62 or rear 64 of the handgrip 50 in which the button 66 is slidably mounted. For example, as shown in FIG. 5, depressing the button 66 causes reduced waist portion 84 to align with the narrow part of a keyhole shaped slot 67 so that the front 62 can be pivoted forward and away from the rear 64 to access the battery compartment 52. As noted above, if a hinge 76 is provided and has a spring bias, the front 62 may be biased to automatically open when the button 66 is pressed (i.e., actuated).

The battery compartment 52 holds a battery 90 and may contain a variety of additional components, such as, e.g., a control circuit or motherboard 92 as discussed further below, a battery connector 94, sensors, an on/off switch, and the like. Likewise an additional battery (not illustrated) may be stored in the battery compartment, which may be electrically connected to the rest of the compressed gas gun 20 for additional power or may be held disconnected as a backup battery.

In operation, when it is desired to remove and/or replace a battery, the user removes the barrel 40, presses the button 66 to release the front 62 from the rear 64 of the handgrip 50, and moves the front 62 away from the rear 64 to reveal the battery compartment 52. With the battery compartment 52 thus accessed, the battery can be easily removed or replaced as desired.

The battery compartment 52 may also contain various controls for operational settings and a "tournament lock" switch, which is generally known in the art to lock the various settings according to predetermined metrics so as to maintain a fair playing field.

In operating the compressed gas gun 10, the trigger 22 is squeezed, thereby actuating the compressed gas cylinder (not shown) attached to the connection 16 to release bursts of compressed gas. The bursts of gas are used to fire paintballs outwardly through the barrel 40. The projectiles (e.g., paintballs) are continually fed by a projectile loader (not shown) to the firing chamber. The battery 90 provides power for the control circuit 92. The battery 90 also powers other electric, electromechanical, and electronic components throughout the compressed gas gun such as solenoids or other actuators for firing, and the like.

The control circuit 92 is, for example, a motherboard or other such processor for executing instructions stored in a memory. The control circuit 92 operates and monitors various electromechanical and electronic components of the compressed gas gun 10 and can control settings such as firing rate and gas pressure, as is known in the art. The control circuit 92 preferably consists of an integrated circuit which performs cycle control logic, an amplifier, a means of controlling valve coil current, e.g. a variable resistor with a "velocity control dial" protruding to the exterior of the control circuit, and a multi-position switch which can be used to disable the trigger 54 (one switch position), or select between semi-automatic (second switch position) and fully-automatic (third switch position) operation when the trigger 22 is pulled. The control circuit 92 may monitor battery power levels and provide indication when there is a lower battery, such as by a LED light, audible signal, or the like.

The arrangement of the present invention, having a releasable access panel 62 and strategically placed release button 66, provides advantages over the prior art. The battery 90 and other internal electronics can be readily accessed without the use of tools (such as a screwdriver). At the same time, accidental opening is prevented. The present invention provides quick and easy use while in the field, particularly for replacing a used battery.

Additionally, the indirectly accessed release mechanism 66 allows for a simplified exterior with a streamlined aesthetic. It also protects the release mechanism from dirt, debris, or accidental actuation. The internal components are likewise protected from dirt and debris, but can be readily and fully accessed when desired. The hinge 76 allows the front 62 and rear 64 to stay attached when the body is opened, and likewise there are no small parts (such as screws) that can be lost.

It is to be appreciated that the operating characteristics of the compressed gas gun (i.e., compressed gas-powered projectile accelerator) of the present invention may utilize non-electronic or electronic components (for example, in the internal trigger mechanism) without altering the inventive concepts and principles embodied therein. Any electronic components, particularly solenoid valves, may be powered by the battery 90 (or multiple batteries) in the battery compartment 52, and selectively energized by the control circuit 92. It is also to be appreciated that additional, optional controls can be incorporated into the control circuit 92 of the preferred electronic embodiment of the compressed gas-powered projectile accelerator of the present invention without altering the inventive concepts and principles embodied therein, such as additional switch positions controlling additional operating modes where the projectile accelerator accelerates finite numbers of projectiles, greater than one, generally known as "burst modes" when the trigger 22 is pulled, as compared to semi-automatic operation, where a single projectile is accelerated per trigger 54 pull, and fully-automatic operation, where projectile acceleration cycles continue successively as long as the trigger 22 remains pulled rearward. Additionally, the timing between cycles can be electronically controlled, and said timing can be made adjustable by the inclusion of an additional control dial in the control circuit 92. The various controls and dials may be mounted inside the battery compartment 52 or externally on the foregrip 50.

It is understood that this invention is not limited to the particular embodiments disclosed, but is intended to cover all modifications and combinations which are within the spirit and scope of the invention as described herein and/or defined by the appended claims, the above description, and/or shown in the attached drawings. One skilled in the art will appreciate that various changes are possible. For example, the release button 66 could be located on different areas of the foregrip 50, preferably with a two-stage actuation or the like to prevent accidental actuation.

What is claimed is:

1. A foregrip for a projectile launcher, the foregrip comprising:

a proximal longitudinal end mounted to a projectile launcher and a distal longitudinal end positioned away from a projectile launcher;

a battery compartment;

an access panel hinged to the battery compartment at the distal longitudinal end of the foregrip; and a release button for separating the access panel from the foregrip, wherein the release button is located on the proximal longitudinal end of the foregrip; wherein actuation of the release button is prevented when the foregrip is mounted to the projectile launcher.

2. The foregrip of claim 1, further comprising a hinge for mounting the access panel to the foregrip.

3. The foregrip of claim 2, wherein the hinge is mounted to the distal longitudinal end of the foregrip.

4. The foregrip of claim 2, wherein the hinge extends longitudinally along the foregrip at a side of the battery compartment.

5. The foregrip of claim 1, wherein the release button is positioned to be inaccessible below a barrel when assembled on a projectile launcher.

6. A projectile launcher comprising:

a main body;

a barrel removably mounted to the main body;

a foregrip mounted to the main body, the foregrip having:

a proximal end mounted to the barrel and a distal end positioned away from the barrel, an internal battery compartment, an access panel, and a release button at the proximal end of the foregrip for separating the access panel from the foregrip, wherein when the barrel is in a mounted position on the main body, the barrel prevents actuation of the release button.

7. The projectile launcher of claim 6, wherein the main body includes a frame extending into the foregrip, and the foregrip has a rear, wherein the access panel is separable from the frame and the rear.

* * * * *